US008371209B2

(12) United States Patent
Boutin, Jr.

(10) Patent No.: US 8,371,209 B2
(45) Date of Patent: Feb. 12, 2013

(54) BOLT CARRIER IMPINGEMENT DEVICE FOR A FIREARM

(75) Inventor: John M. Boutin, Jr., Holland, MA (US)

(73) Assignee: Holland Automatic Rifles LLC, Holland, MA (US)

( * ) Notice: Subject to any disclaimer, the term of this patent is extended or adjusted under 35 U.S.C. 154(b) by 223 days.

(21) Appl. No.: 12/658,211

(22) Filed: Feb. 4, 2010

(65) Prior Publication Data

US 2011/0185886 A1 Aug. 4, 2011

(51) Int. Cl.
*F41A 5/24* (2006.01)

(52) U.S. Cl. ..... 89/179; 89/191.01

(58) Field of Classification Search ..... 42/16, 17, 42/19; 89/179, 183, 191.01, 191.02, 192
See application file for complete search history.

(56) References Cited

U.S. PATENT DOCUMENTS

| | | | | |
|---|---|---|---|---|
| 4,244,273 | A * | 1/1981 | Langendorfer et al. | 89/193 |
| 5,900,577 | A * | 5/1999 | Robinson et al. | 89/191.01 |
| 6,848,351 | B1 * | 2/2005 | Davies | 89/191.01 |
| 7,316,091 | B1 | 1/2008 | Desomma | |
| 7,461,581 | B2 * | 12/2008 | Leitner-Wise | 89/191.01 |
| 7,784,211 | B1 * | 8/2010 | Desomma | 42/16 |

* cited by examiner

*Primary Examiner* — Bret Hayes
(74) *Attorney, Agent, or Firm* — Bennet K. Langlotz; Langlotz Patent & Trademark Works, Inc.

(57) ABSTRACT

A bolt carrier impingement device for a firearm has a body including a rearward facing surface. The rearward facing surface of the bolt carrier impingement device abuts the forward facing surface of the bolt carrier, thereby transferring all rearward force imparted to the front of the bolt carrier impingement device through only the forward facing surface of the bolt carrier. The rearward facing surface of the body may be a notch and the forward facing surface of the bolt carrier may be a buttress. The bolt carrier may include a cam aperture formed through a top surface rearward of the forward facing surface. A forward most portion of the impingement device may terminate in front of the cam aperture. A bottom surface of the body may form a slot that forms an arch over the cam aperture.

16 Claims, 7 Drawing Sheets

BOLT CARRIER IMPINGEMENT DEVICE FOR A FIREARM

FIELD OF THE INVENTION

The present invention relates to firearms, and more particularly to a bolt carrier impingement device that connects to a bolt carrier without requiring any fasteners to transfer forces from the bolt carrier impingement device to the bolt carrier.

BACKGROUND OF THE INVENTION

Gas operation is a system of operation used to provide energy to operate autoloading firearms. In gas operation, a portion of high pressure gas from the cartridge being fired is used to power a mechanism to extract the spent case and chamber a new cartridge. Energy from the gas is harnessed through either a port in the barrel or a trap at the muzzle. This high-pressure gas impinges on a surface such as a piston head to provide motion for unlocking of the action, extraction of the spent case from the chamber, ejection of the spent case, cocking of the hammer or striker, chambering of a fresh cartridge, and locking of the action.

Most current gas systems employ some type of piston. The face of the piston is acted upon by gas from the combustion of the propellant from the barrel of the firearm. With a short-stroke or tappet system, the piston moves separately from the bolt group. It may operate through a connecting rod or assembly. The rod mechanically engages a bolt carrier impingement device, pushing the bolt carrier backward after the firing of the cartridge. The energy is imparted in a short, violent push, and the motion of the gas piston is then arrested by a return spring. This allows the bolt carrier assembly to continue through the operating cycle using kinetic energy.

While gas piston operating systems generally work well, the sharp impulse forces applied to the bolt carrier impingement device by the rod can be substantial. In fact, these forces can loosen the bolt carrier impingement device from the bolt carrier if the bolt carrier impingement device and bolt carrier are attached in a conventional manner.

An example of a firearm bolt carrier with mechanical/gas key that addresses this problem is found in U.S. Pat. No. 7,316,091 (Desomma). The Desomma patent discloses a bolt carrier that includes a buttress formed in a top surface. Although the Desomma patent provides improved strength of the junction between its key and bolt carrier, there are a number of potential disadvantages, at least for some applications. First, the bolt carrier must be modified to include a pocket cut in its top surface. Furthermore, the forward most portion of the key must be located rearward of the camming surface, which may require changes to the length of the connecting rod and/or other customization of the gas piston system.

It is therefore an object of this invention to provide a bolt carrier impingement device for a firearm that connects to a bolt carrier without requiring any fasteners to transfer forces from the bolt carrier impingement device to the bolt carrier.

SUMMARY OF THE INVENTION

The present invention provides an improved bolt carrier impingement device for a firearm, and overcomes the above-mentioned disadvantages and drawbacks of the prior art. As such, the general purpose of the present invention, which will be described subsequently in greater detail, is to provide an improved bolt carrier impingement device for a firearm that has all the advantages of the prior art mentioned above.

To attain this, the preferred embodiment of the present invention essentially comprises a body including a rearward facing surface. The rearward facing surface of the bolt carrier impingement device abuts the forward facing surface of the bolt carrier, thereby transferring all rearward force imparted to the front of the bolt carrier impingement device through only the forward facing surface of the bolt carrier. The rearward facing surface of the body may be a notch and the forward facing surface of the bolt carrier may be a buttress. The bolt carrier may include a cam aperture formed through a top surface rearward of the forward facing surface. A forward most portion of the impingement device may terminate in front of the cam aperture. A bottom surface of the body may form a slot that forms an arch over the cam aperture. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
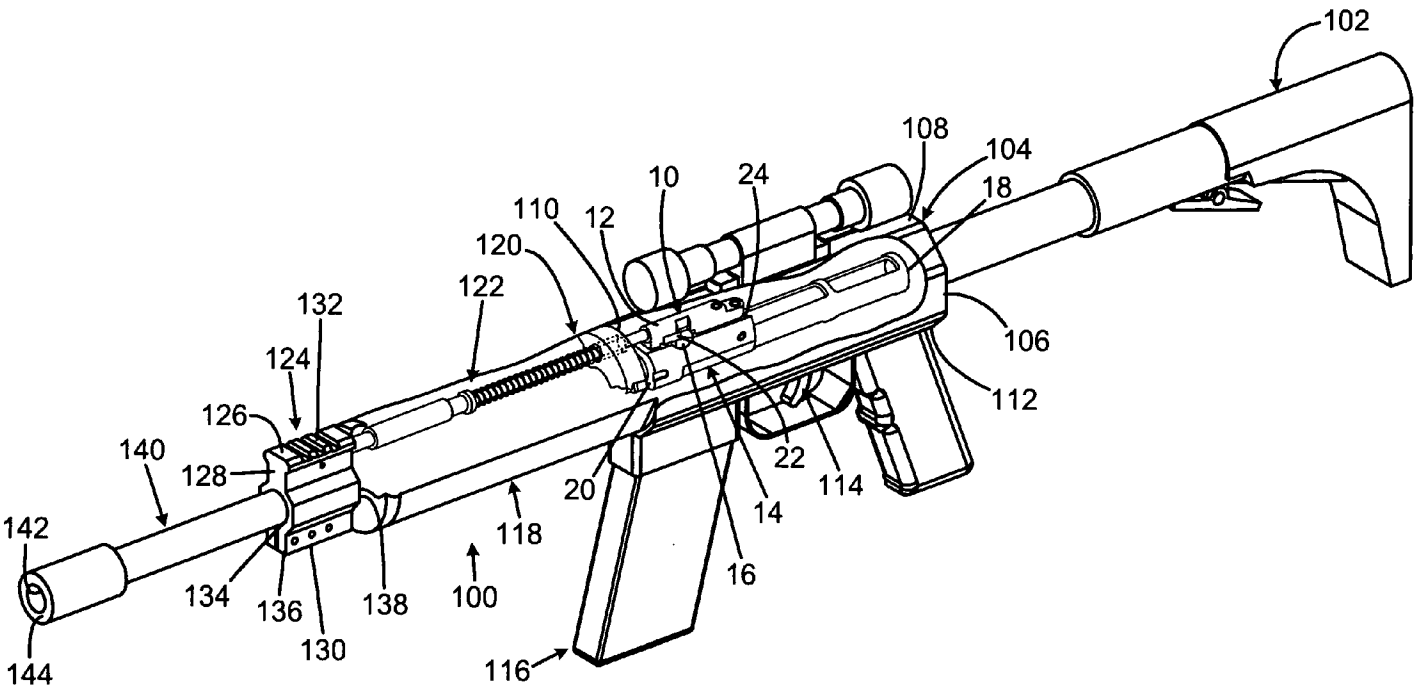
FIG. 1 is a cutaway perspective view of the bolt carrier impingement device for a firearm constructed in accordance with the principles of the present invention installed in a firearm.

An embodiment of the bolt carrier impingement device for a firearm of the present invention is shown and generally designated by the reference numeral 10.

Figure 2:
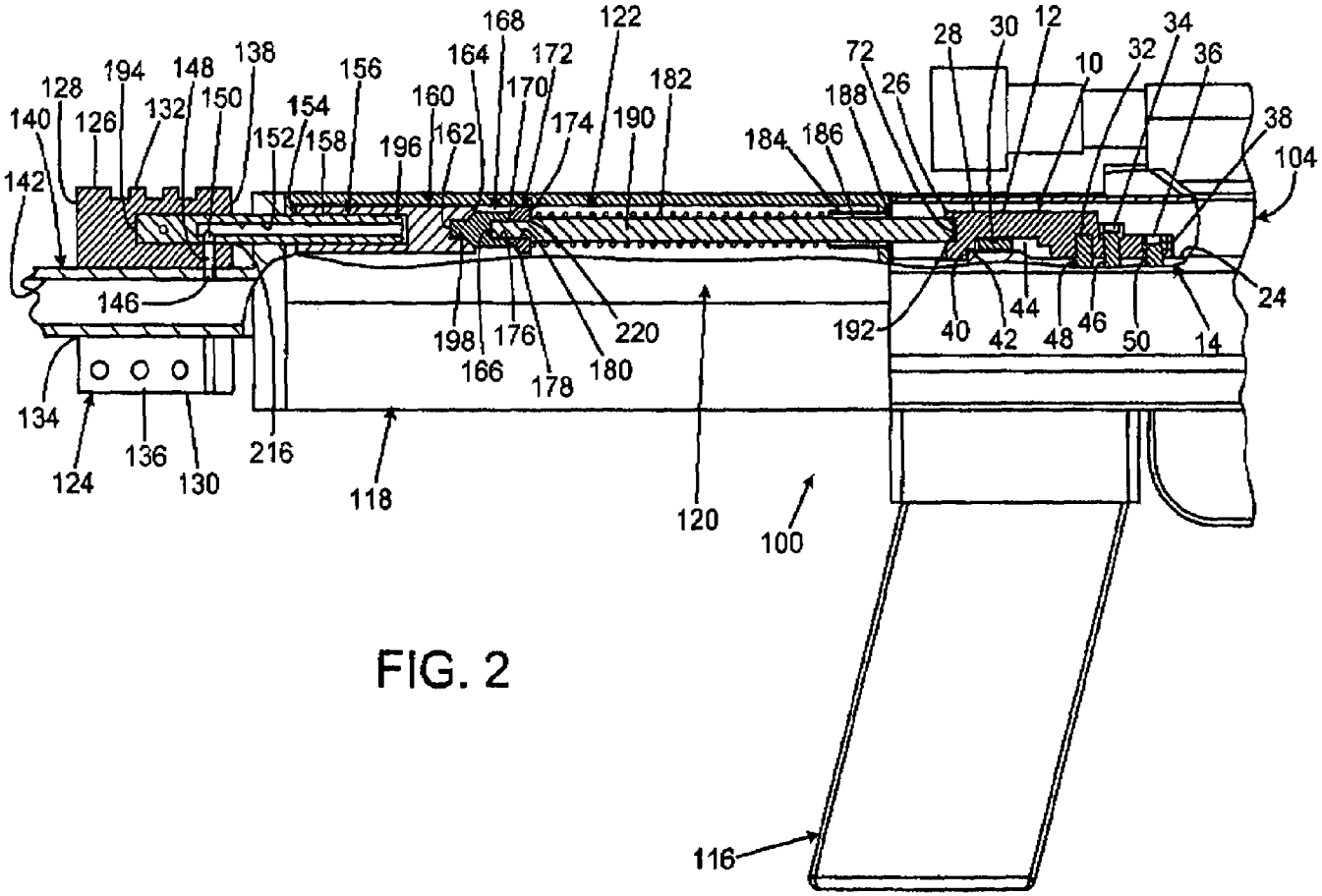
FIG. 2 is a side cutaway view of the present invention installed in a firearm.
Figure 3:
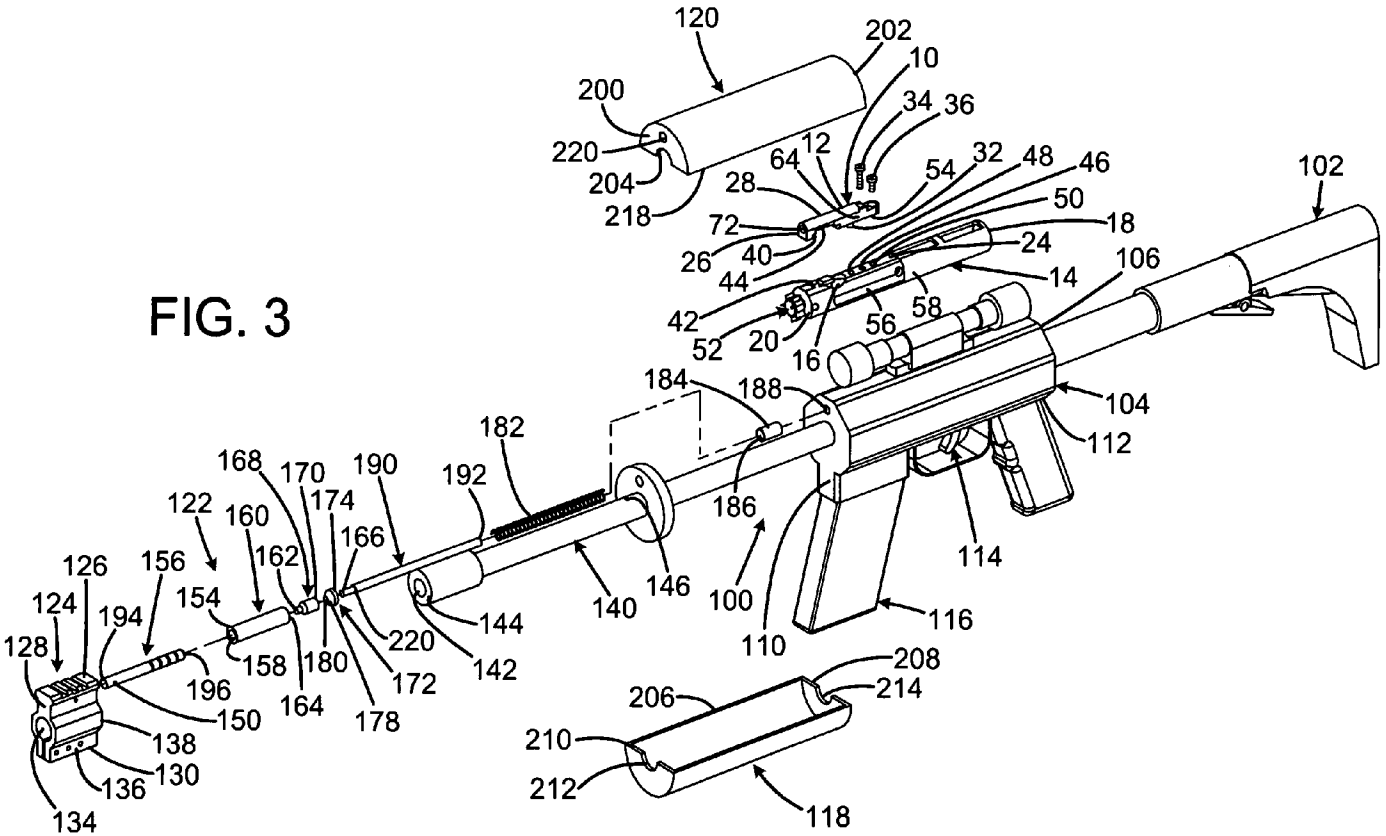
FIG. 3 is an exploded perspective view of the present invention and a firearm in which the present invention can be installed.
Figure 4:
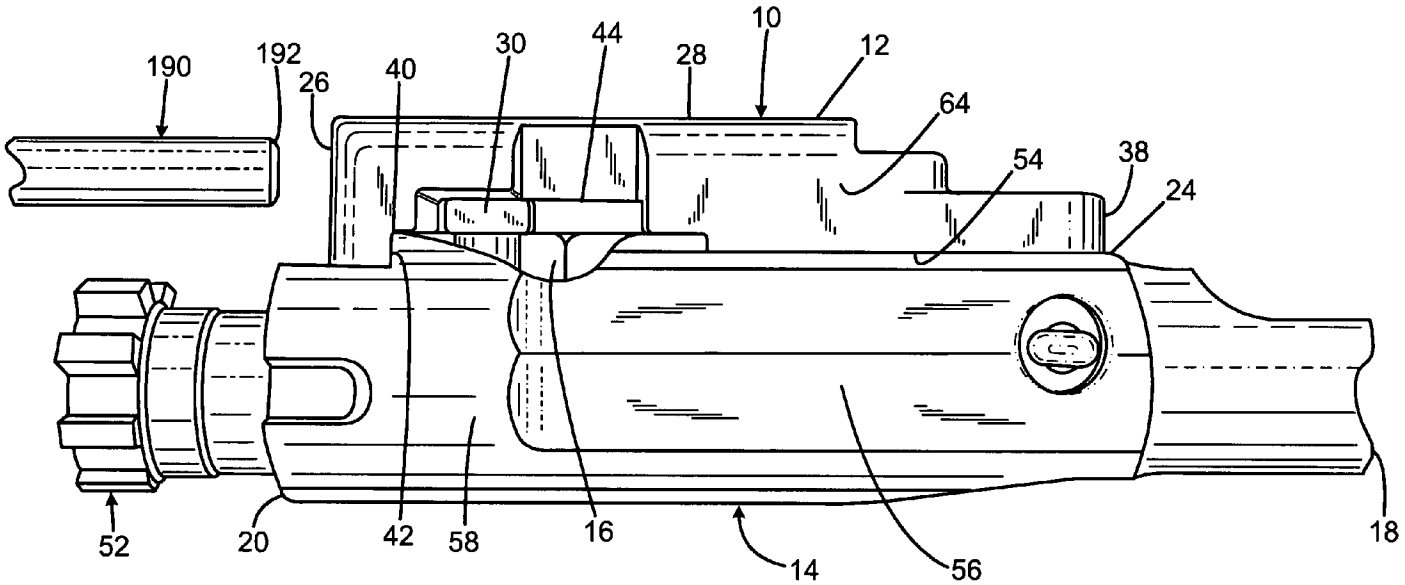
FIG. 4 is a side view of the present invention attached to a bolt carrier.
Figure 5:
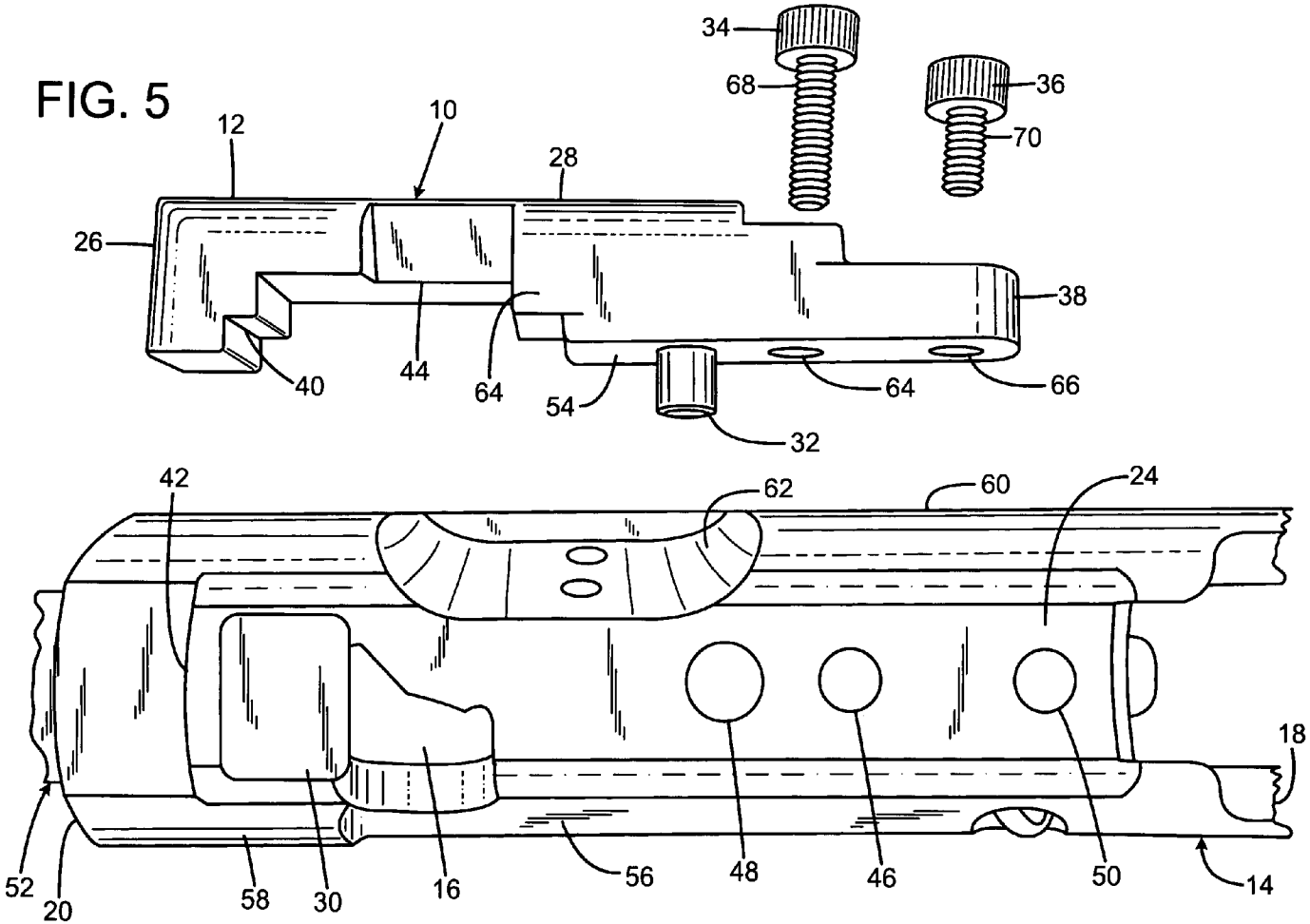
FIG. 5 is a side exploded view of the present invention and a top view of a bolt carrier to which the present invention can be attached.
Figure 6:
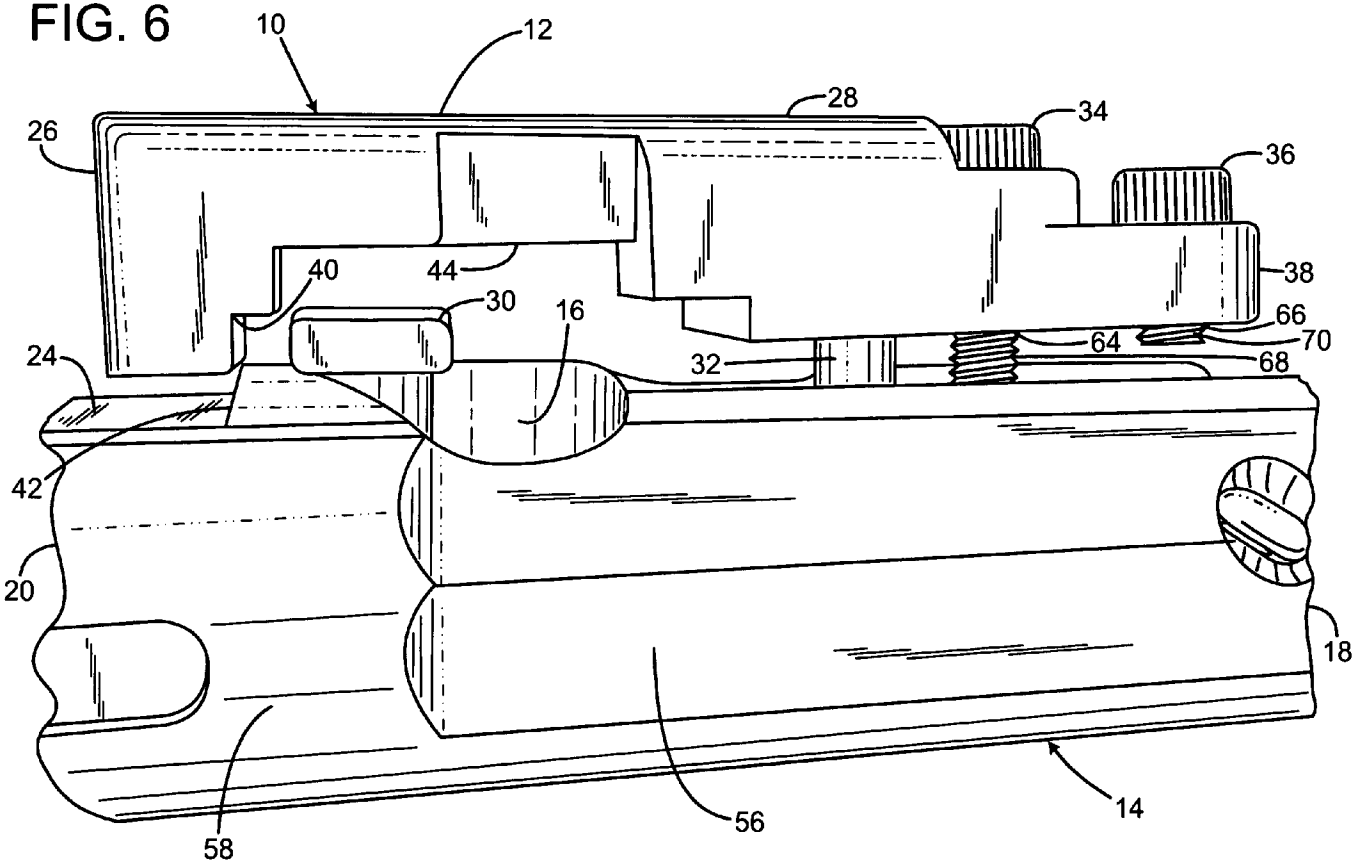
FIG. 6 is a side view of the present invention partially detached from a bolt carrier.
Figure 7:
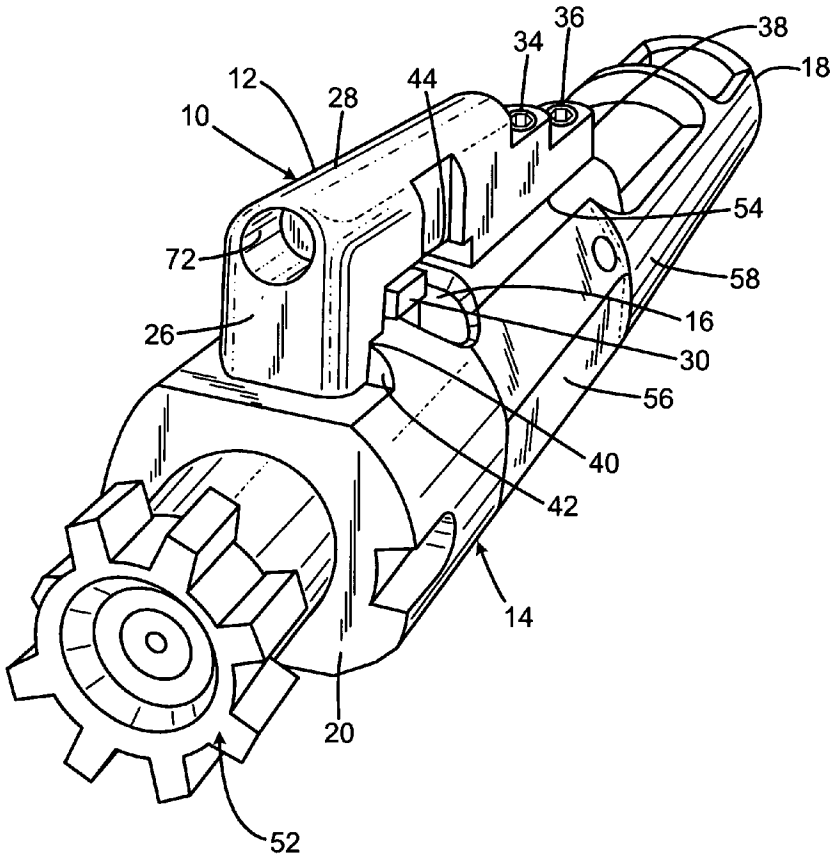
FIG. 7 is a perspective view of the present invention installed on a bolt carrier.

FIGS. 1-3 illustrate the improved bolt carrier impingement device for a firearm 10 of the present invention installed in a firearm 100. More particularly, the firearm is a rifle having an upper receiver 104 with a stock 102 extending rearward from the rear 106. A trigger 114 and a magazine 116 extend downwardly from the upper receiver's bottom 112.

The muzzle 144 end of a barrel 140 extends forwardly from the front 110 of the upper receiver. The barrel has a central bore 142. An aperture 146 enables communication between the bore 142 and the exterior of the barrel.

A lower handguard 118 and an upper handguard 120 removably encircle the barrel with their rears 202 and 208 abutting the front of the upper receiver. The bottom 218 of the upper handguard defines a notch 204 in the front 200 and a notch (not visible) in the rear 202. The top 206 of the lower handguard defines a notch 212 in the front 210 and a notch 214 and the rear 208. The notches in the handguards receive the barrel 140. The front of the upper handguard defines a bore 222 in the front and an axially registered bore (not visible) in its rear. The front bore in the upper handguard receives a gas tube 156, and the rear bore in the upper handguard receives an action rod spring bushing 184.

A gas block 124 clamps onto the barrel using a clamp 136 having a bore 134. The rear 138 of the gas block abuts the front 200 of the upper handguard and the front 210 of the lower handguard. The rear of the gas block defines a bore 216. A gas block passage 148 enables fluid communication between the bore 134 and the bore 216.

The upper receiver carries a reciprocating bolt carrier 14 that is movable between a locked position and an unlocked position. The bolt carrier supports and positions a bolt 52. The locked position is the position in which the bolt carrier has positioned the bolt for firing. The unlocked position is any position other than the locked position, which includes the position where the bolt carrier has retracted the bolt from the chamber to permit ejection of a casing and insertion of a cartridge from the magazine 116. The bolt carrier impingement device 10 is coupled to the bolt carrier and is employed by a gas piston system 122 to move the bolt carrier between the locked and the unlocked positions.

The gas piston system is positioned above the barrel, extends parallel to the barrel, and terminates in an engagement with the bolt carrier impingement device. The gas piston system has a gas tube 156 whose front 194 is received by the bore 216 in the rear of the gas block. The rear 196 of the gas tube defines a bore 152. An aperture 150 enables fluid communication between the bore 152 and the gas block passage 148. A reciprocating gas piston 160 has a front 154 defining a bore 158. The bore 158 receives the rear of the gas tube. The rear 164 of the gas piston defines an aperture 198. The aperture 198 receives the front 162 of a connecting link 168. The rear 170 of the connecting link defines a bore 176.

The bore 176 receives the front 166 of a rod 190. The front of the rod has a narrower diameter than the remainder of the rod, forming a shoulder 220. The front of the rod is received by a bore 180 in a rod head 172. The rear 174 of the rod head abuts the shoulder 220, and the front 178 of the rod head abuts the rear 170 of the connecting link.

The rod extends rearward and is received by a bore 186 in an action rod spring bushing 184. The action rod spring bushing is positioned on the rod where the rod passes through the aperture in the rear of the upper handguard. Subsequently, the rod passes through an aperture 188 in the front of the upper receiver. The rear 192 of the rod is received by an aperture 72 in the front 26 of the bolt carrier impingement device 10. A piston return spring 182 encircles the rod between the rod head 172 and the rearmost portion of the action rod spring bushing 184. A portion of the rear length of the piston return spring is encircled by the action rod spring bushing.

The rifle is ready for firing when the bolt carrier is in the locked position with a cartridge chambered. When the rifle is fired by pulling the trigger 114, gas from the detonated round escapes from the barrel bore 142 through the aperture 146. The escaped gas passes through the gas block passage 148 and enters the gas tube bore 152 though the aperture 150. Through the use of the gas piston, the connecting link and rod head push the rod rearward. Rearward movement of the rod pushes against the bolt carrier impingement device, moving the bolt carrier to the unlocked position. The return spring 182 subsequently pushes the gas piston system 122 forward to enable the bolt carrier to return to its locked position.

In a conventional firearm, similar to that described, the bolt carrier key is bolted or riveted to the top surface of a bolt carrier. Forces generated by the engagement of the rod with the bolt carrier key can result in loosening or fracturing of the junction between the bolt carrier key and the bolt carrier if they are attached in a conventional manner. Stresses caused by the force of the rod can overcome the hardware couplings of the bolt carrier key and detach it from the bolt carrier, resulting in a stoppage and possible damage or injury.

FIGS. 4-7 illustrate the improved bolt carrier impingement device for a firearm 10 of the present invention and its associated bolt carrier 14. More particularly, the bolt carrier impingement device 10 has a body 12 having a top 28, a bottom 54, a front 26, a rear 38, and a left side 64. The front of the body defines an aperture 72 that receives the rear 192 of the rod 190. The bottom and left side of the body define a slot 44. The forward most portion of the slot 44 includes a step notch 40 on the bottom of the body. A retention pin 32 protrudes downwardly from the bottom of the body rearward of the slot 44. Two bores 64 and 66 pass through the rear 38 of the body behind the retention pin. The bore 64 receives the threaded portion 68 of a first screw 34. The bore 66 receives the threaded portion 70 of a second screw 36. The threaded portion 68 is longer than the threaded portion 70. This is the case because the thickness of the body 12 decreases stepwise at the rear 38, making the bore 64 longer than the bore 66.

The bolt carrier 14 has a front 20, rear 18, top 24, left side 58, and right side 60. The top of the bolt carrier includes a camming surface in the form of an aperture 16. A cam pin 30 extends from the bolt 52 carried by the bolt carrier and is received within the aperture 16. The interaction of the cam pin and aperture 16 are not described in detail as they are well known in the art. The cam pin and aperture 16 are described to provide a basis for orientation and positioning of the bolt carrier impingement device 10.

The top of the bolt carrier defines a step 42 or buttress immediately in front of the aperture 16. The top of the bolt carrier also defines a retention pin aperture 48, a first screw aperture 46, and a second screw aperture 50. The retention pin aperture, first screw aperture, and second screw aperture are located rearward of the aperture 16. The first screw aperture and second screw aperture are axially registered with the bore 64 and the bore 66 when the retention pin 32 is inserted into the retention pin aperture and the body 12 is positioned parallel to the bolt carrier.

In the current embodiment, a forward portion of the left side 56 of the bolt carrier 14 must be cut away to facilitate charging the weapon by right handed shooters. A forward portion of the right side 62 of the bolt carrier must be cut away to facilitate charging the weapon by left handed shooters. The bolt carrier impingement device 10 occupies the space of the charging handle in prior art rifles.

To attach the bolt carrier impingement device 10 to the bolt carrier 14, the retention pin 32 is inserted into the retention pin aperture 48. The bolt carrier impingement device is then aligned parallel to the bolt carrier so that the step notch 40 in the slot 44 closely receives the step 42 on the top surface of the bolt carrier. The first screw 34 and second screw 36 are then inserted through the bores 64 and 66 and threadedly secured within the first screw aperture 46 and second screw aperture 50.

Upon application of force from the rod 190 to the bolt carrier impingement device, the abutting engagement between the step notch 40 and the step 42 absorbs the impact forces, transmits them to the bolt carrier, and prevents damage to the fasteners joining the bolt carrier impingement device to the bolt carrier. The slot 44 in the bottom of the bolt carrier impingement device enables the cam pin 30 to move freely within the aperture 16 without encountering interference from the bolt carrier impingement device body 12. The slot 44 enables the forward most portion of the bolt carrier impingement device to terminate in front of the aperture 16. This enables the current invention to be used with a standard, unmodified gas piston system 122.

Note that the bolt carrier impingement device 10 may be employed on any type of firearm utilizing a short-stroke gas piston system for reloading, including both semi-automatic and fully automatic rifles, and the principles of the invention may be applied to other firearms systems.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a bolt carrier impingement device for a firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bolt carrier impingement device for a firearm having a reciprocating bolt carrier with a forward facing surface, the bolt carrier impingement device comprising:

a body including a rearward facing surface;

wherein the rearward facing surface of the bolt carrier impingement device abuts the forward facing surface of the bolt carrier, thereby transferring all rearward force imparted to the front of the bolt carrier impingement device through only the forward facing surface of the bolt carrier; and wherein the bolt carrier includes a cam aperture formed through a top surface rearward of the forward facing surface, wherein a forward most portion of the impingement device terminates in front of the cam aperture.

2. The impingement device of claim 1 wherein the firearm further includes a gas piston system including a rod terminating in an aperture in the impingement device, wherein the rod imparts rearward force to the body when the firearm is fired.

3. The impingement device of claim 1 wherein the rearward facing surface of the body is a notch and the forward facing surface of the bolt carrier is a buttress.

4. The impingement device of claim 1 wherein the body includes a retention pin that is received by an aperture in a top surface of the bolt carrier.

5. The impingement device of claim 1 wherein the body includes a bore, and a threaded portion of a screw passes through the bore and is threadedly received by an aperture in a top surface of the bolt carrier.

6. A bolt carrier impingement device for a firearm having a reciprocating bolt carrier with a forward facing surface, the bolt carrier impingement device comprising:

a body including a rearward facing surface:

wherein the rearward facing surface of the bolt carrier impingement device abuts the forward facing surface of the bolt carrier, thereby transferring all rearward force imparted to the front of the bolt carrier impingement device through only the forward facing surface of the bolt carrier; and wherein the bolt carrier includes a cam aperture formed through a top surface rearward of the forward facing surface, wherein the body has a slot formed by a bottom surface, and wherein the slot in the body forms an arch over the cam aperture.

7. The impingement device of claim 6 wherein the slot enables a cam pin received within the cam aperture to move within the cam aperture without obstruction from the body.

8. The impingement device of claim 6 wherein the slot includes the rearward facing surface.

9. A firearm comprising:

a reciprocating bolt carrier;

a bolt carrier impingement device connected to the bolt carrier, the bolt carrier impingement device having a rearward facing surface;

the bolt carrier having a forward facing surface;

wherein the rearward facing surface of the bolt carrier impingement device abuts the forward facing surface of the bolt carrier, thereby transferring all rearward force imparted to the front of the bolt carrier impingement device through only the forward facing surface of the bolt carrier; and wherein the bolt carrier includes a cam aperture formed through a top surface rearward of the forward facing surface, wherein a forward most portion of the bolt carrier impingement device terminates in front of the cam aperture.

10. The firearm of claim 9 wherein the firearm further includes a gas piston system including a rod terminating in an aperture in the impingement device, wherein the rod imparts rearward force to the body when the firearm is fired.

11. The firearm of claim 9 wherein the rearward facing surface of the bolt carrier impingement device is a notch and the forward facing surface of the bolt carrier is a buttress.

12. The firearm of claim 9 wherein the bolt carrier impingement device includes a retention pin that is received by an aperture in a top surface of the bolt carrier.

13. The firearm of claim 9 wherein the bolt carrier impingement device includes a bore, and a threaded portion of a screw passes through the bore and is threadedly received by an aperture in a top surface of the bolt carrier.

14. A firearm comprising:

a reciprocating bolt carrier;

a bolt carrier impingement device connected to the bolt carrier;

the bolt carrier impingement device having a rearward facing surface;

the bolt carrier having a forward facing surface;

wherein rearward facing surface of the bolt carrier impingement device abuts the forward facing surface of the bolt carrier, thereby rearward force imparted to the front of the bolt carrier impingement device through only the forward facing surface of the bolt carrier; and wherein the bolt carrier includes a cam aperture formed through a top surface rearward of the forward facing surface, wherein the bolt carrier impingement device has a slot formed by a bottom surface, and wherein the slot in the bolt carrier impingement device forms an arch over the cam aperture.

15. The firearm of claim 14 wherein the slot enables a cam pin received within the cam aperture to move within the cam aperture without obstruction from the bolt carrier impingement device.

16. The firearm of claim 14 wherein the slot includes the rearward facing surface.

* * * * *